US006758656B2

(12) United States Patent
Maier et al.

(10) Patent No.: US 6,758,656 B2
(45) Date of Patent: Jul. 6, 2004

(54) MULTI-STAGE INTERNAL GEAR/TURBINE FUEL PUMP

(75) Inventors: Eugen Maier, Clarkston, MI (US); Michael Raymond Raney, Mendon, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/126,190

(22) Filed: Apr. 19, 2002

(65) Prior Publication Data

US 2002/0187051 A1 Dec. 12, 2002

Related U.S. Application Data

(60) Provisional application No. 60/291,556, filed on May 17, 2001.

(51) Int. Cl.[7] ..... F04B 23/14

(52) U.S. Cl. ..... 417/203; 417/244; 418/61.3

(58) Field of Search ..... 417/203, 205, 417/244, 310, 423.3, 423.5, 423.6, 423.7, 423.14; 418/170, 171, 32, 61.3, 78, 166; 123/445; 415/55.1, 55.2, 55.5

(56) References Cited

U.S. PATENT DOCUMENTS

| | | | | | |
|---|---|---|---|---|---|
| 4,199,305 | A | * | 4/1980 | Pareja | 417/440 |
| 5,139,395 | A | | 8/1992 | Kemmner | 417/366 |
| 5,393,203 | A | * | 2/1995 | Hantle | 417/203 |
| 5,544,540 | A | | 8/1996 | Homan | 74/467 |
| 5,554,019 | A | | 9/1996 | Hodge | 418/171 |
| 5,593,287 | A | * | 1/1997 | Sadakata et al. | 417/366 |
| 5,711,408 | A | | 1/1998 | Dick | 192/85 R |
| 5,722,815 | A | | 3/1998 | Cozens | 417/310 |
| 5,733,111 | A | | 3/1998 | Yu et al. | 418/78 |
| 5,762,484 | A | | 6/1998 | Whitham | 418/150 |
| 5,797,734 | A | | 8/1998 | Kizer et al. | 418/9 |
| 5,997,262 | A | * | 12/1999 | Finkbeiner et al. | 417/410.4 |
| 6,017,202 | A | | 1/2000 | Durnack et al. | 418/32 |
| 6,106,240 | A | * | 8/2000 | Fischer et al. | 417/203 |
| 6,113,360 | A | | 9/2000 | Yu et al. | 417/310 |
| 6,149,410 | A | | 11/2000 | Cooper | 418/32 |
| 6,186,118 | B1 | | 2/2001 | Spakowski | 123/452 |
| 6,230,691 | B1 | | 5/2001 | Coha et al. | 123/514 |
| RE37,632 | E | | 4/2002 | Bouchauveau et al. | 123/458 |
| 6,363,917 | B1 | | 4/2002 | Hopley | 123/502 |
| 6,379,132 | B1 | | 4/2002 | Williams | 417/470 |
| 6,394,762 | B1 | | 5/2002 | Collingborn et al. | 417/254 |
| 6,402,460 | B1 | | 6/2002 | Fischer et al. | 415/55.1 |
| 6,405,717 | B1 | | 6/2002 | Beyer et al. | 123/514 |
| 6,406,269 | B1 | | 6/2002 | Dingle et al. | 417/218 |

(List continued on next page.)

FOREIGN PATENT DOCUMENTS

| | | | | |
|---|---|---|---|---|
| DE | 36 13 734 | | 10/1987 | F02B/53/00 |
| EP | 0 657 640 A1 | * | 6/1995 | |

OTHER PUBLICATIONS

See U.S. Ser. No. 10/145,321, filed May 14, 2002, for: Multi–Stage Internal Gear Fuel Pump, Inventors: Eugen Maier and Michael Raymond Raney.

*Primary Examiner*—Justine R. Yu
*Assistant Examiner*—Han L Liu
(74) *Attorney, Agent, or Firm*—Jimmy L. Funke

(57) ABSTRACT

A multi-stage internal gear/turbine fuel pump for a vehicle includes a housing having an inlet and an outlet and a motor disposed in the housing. The multi-stage internal gear/turbine fuel pump also includes a shaft extending axially and disposed in the housing. The multi-stage internal gear/turbine fuel pump further includes a plurality of pumping modules disposed axially along the shaft. One of the pumping modules is a turbine pumping module and another of the pumping modules is a gerotor pumping module for rotation by the motor to pump fuel from the inlet to the outlet.

32 Claims, 4 Drawing Sheets

U.S. PATENT DOCUMENTS

| | | | | |
|---|---|---|---|---|
| 6,408,830 | B1 | 6/2002 | McGrath | 123/509 |
| 6,435,810 | B1 | 8/2002 | Fischer et al. | 415/55.1 |
| 6,447,263 | B1 | 9/2002 | Cooke et al. | 417/297 |
| 6,454,521 | B1 | 9/2002 | Anderson et al. | 415/55.1 |
| 6,464,450 | B1 | 10/2002 | Fischer | 415/55.1 |
| 6,499,941 | B1 | 12/2002 | Fischer | 415/55.4 |
| 6,505,644 | B2 | 1/2003 | Coha et al. | 137/565.22 |
| 6,517,327 | B2 | 2/2003 | Beyer et al. | 417/363 |
| 6,527,506 | B2 | 3/2003 | Pickelman et al. | 415/55.1 |
| 6,533,538 | B2 | 3/2003 | Aslam et al. | 415/55.2 |
| 6,546,916 | B2 | 4/2003 | Hopley | 123/502 |
| 6,623,237 | B2 | 9/2003 | Harris et al. | 415/55.1 |
| 6,626,148 | B1 | 9/2003 | Cooke et al. | 123/447 |

* cited by examiner

FIG 1
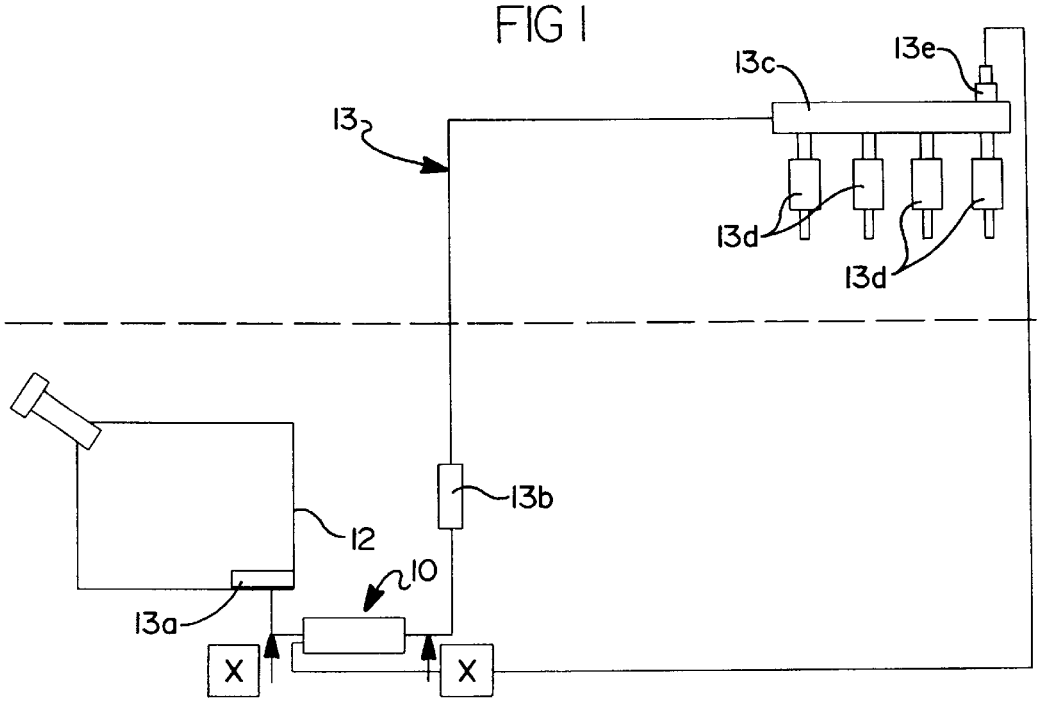
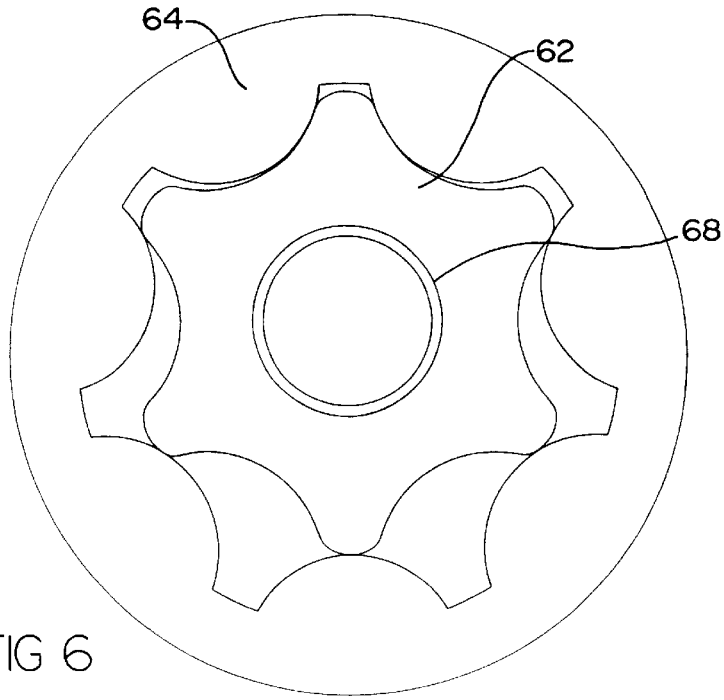
FIG 6

FIG 2
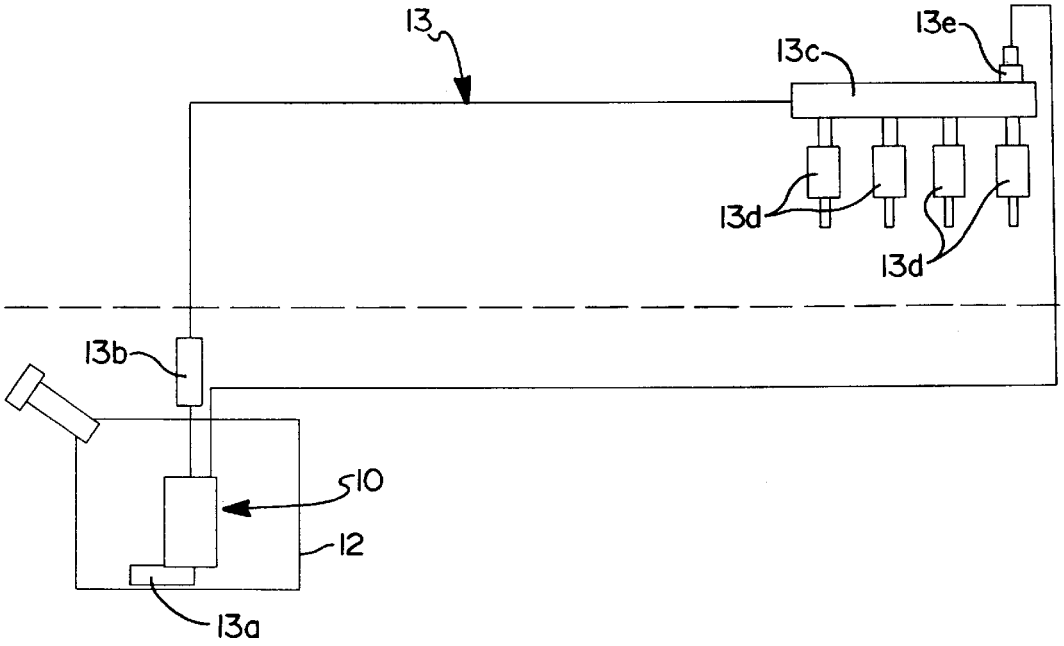
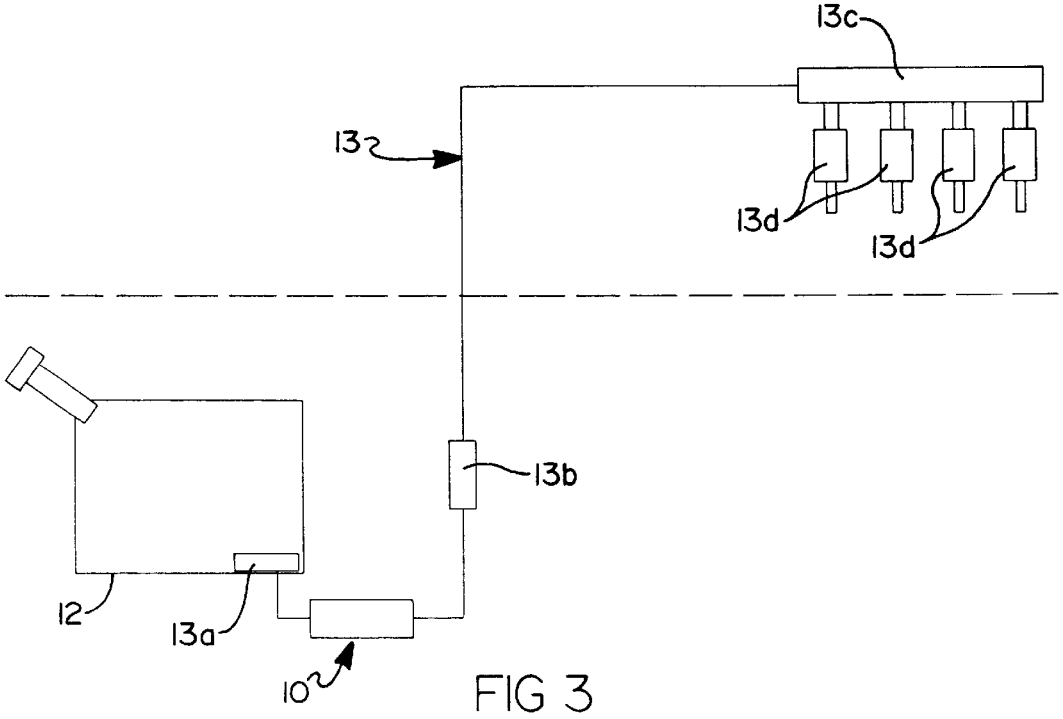
FIG 3

MULTI-STAGE INTERNAL GEAR/TURBINE FUEL PUMP

CROSS-REFERENCE TO RELATED APPLICATION(S)

The present invention claims the priority date of copending U.S. Provisional Patent Application Serial No. 60/291,556, filed May 17, 2001.

GOVERNMENT RIGHTS IN INVENTION

The present invention was made with government support under Government Contract No. DE-FC02-99EE50573 awarded by the United States Department of Energy. The government has certain rights in this invention.

TECHNICAL FIELD

The present invention relates generally to fuel pumps for vehicles and, more particularly, to multi-stage internal gear/turbine fuel pump for a vehicle.

BACKGROUND OF THE INVENTION

It is known to provide a fuel tank in a vehicle to hold fuel to be used by an engine of the vehicle. It is also known to provide a fuel pump to pump fuel from the fuel tank to the engine. Examples of such fuel pumps are mechanically or electrically driven piston pumps, turbine pumps, roller vane pumps, progressive cavity pumps, gear pumps and mechanically, electrically or hydraulically driven diaphragm pumps.

Some of the pumps used in systems for direct injection of volatile fluids such as gasoline are cam driven or crankshaft/connecting rod mechanism pumps. These pumps require a driving shaft and dynamic seals to prevent fuel leakage outside a pump housing or fuel to penetrate into a lubricated driving mechanism area. These pumps also require a shaft coupling a pump driving shaft with a source of rotational movement (e.g., engine crankshaft, camshaft). Some of these driving sources impose a specific location for the pump in the engine compartment. Dynamic sealing systems are usually expensive and do not guarantee an extensive leak free working life that meets fuel emission and safety requirements for modern engines. Engine driven pumps for direct injection systems also require an additional lift or prime pump to supply fuel from the fuel tank to the engine driven pump thereby increasing system cost. Pumps that are engine driven also have difficulty achieving pressure during vehicle starting conditions since rotational speed is typically below ideal pump speed, thus resulting in starts under less than ideal conditions. This could lead to degraded start performance and higher emissions. Further, piston type engine drive pumps typically utilize drain and re-circulation lines to contain leak and dissipate heat, respectively, adding to cost and complexity.

Known fuel pumps such as gerotor, turbine, and rollervane are able to operate up to about one (1) MPa of discharge pressure. That is not sufficient to satisfy the requirements of a high-pressure PFI or low-pressure Gasoline Direct Injection Fuel System which may need up to three (3) Mpa.

In the case of existing gerotor pumps, of the type used in automotive applications, ability to operate at higher pressure on low viscosity gasoline fuel is limited by internal leakage and high friction causing loss of volumetric efficiency and requiring high power consumption, respectively. Additionally, high friction can cause pump durability and noise concerns. In automotive type gerotor fuel pumps, where an inner gear is the driven member, high friction results as pressure is increased and the inner and outer gears are forced against the axle and housing, respectively. Additionally, higher friction also results as the pressure forces the inner gear against a plate member.

With existing gerotor type fuel pumps, it is typical that the pumping section is separated from the motor section, the pump section being assembled on an extension of the shaft, making the assembly less compact. The shaft drives the pumping section through a driver, in the case of the gerotor pump, the inner gear being the shaft driven element. The drive shaft, to improve volumetric efficiency, may require some type of dynamic sealing, especially at higher outlet pressure, to prevent high leakage along the shaft back into the inlet area. Also, the driving shaft may need guiding to prevent vibrations and bending of the cantilever/driver section of the shaft, phenomena that might induce the failure of the pump in absence of a precise guiding feature. But tight guiding/sealing around the driving shaft could produce high wear at elevated discharge pressure, that also can end in failure of the pump, unless expensive wear resistant materials are used for shaft, guiding and sealing systems.

For medium pressure application, such as gasoline direct injection operating at about three (3) Mpa, attempts to use electrically driven single-stage internal gear pumps usually results in low efficiency-high power requirements. High leakage between gear teeth and gear faces reduces efficiency at high operating pressure necessitating the need for very tight tolerances. Tight tolerances usually result in high costs and poor durability.

Therefore, it is desirable to provide a fuel pump by a combination of a turbine fuel supply module and an outer-gear driven gerotor fuel supply module, integrated with a brushless electrical motor and motor controller in a compact and robust design for a vehicle. It is also desirable to provide a fuel pump for a vehicle by providing a medium pressure fuel pump by combination of a turbine fuel supply module and an outer-gear driven gerotor fuel supply module, integrated with a brushless electrical motor and motor controller in a compact and robust design, to satisfy the requirements of a medium-pressure fuel delivery system. It is desirable to provide a pump that can be used for pumping volatile or non-volatile fluids for a vehicle. It is also desirable to provide a fuel pump that has an electrical driving mechanism contained within a common housing, eliminating the need for additional prime or lift pumps. It is further desirable to provide a fuel pump that eliminates any source of fluid leak for a vehicle and is able to provide adequate flow at desired pressure during vehicle starting conditions. Additionally, it is desirable to provide a pump that can be mounted either in a fuel line or fuel tank. It is still further desirable to provide a pump not requiring drain or re-circulating lines. It is also desirable to provide a pump that can be modular in design so that pumping sections can be added to reduce sectional pressure differential and provide for operation at higher pressure and efficiency at nominal tolerance levels.

SUMMARY OF THE INVENTION

It is, therefore, one object of the present invention to provide a multi-stage internal gear/turbine fuel pump combined with a turbine or other type of supply fuel pump module for a fuel tank or for "in-line" mounting in a vehicle.

It is another object of the present invention to provide a multi-stage internal gear/turbine fuel pump for a vehicle that provides a driving mechanism completely contained within a pump housing.

It is yet another object of the present invention to provide a multi-stage internal gear/turbine fuel pump for a vehicle that provides high discharge fuel pressure to satisfy requirements of a medium pressure gasoline direct injection fuel system pressure that can not be generated by a single-stage internal gear pump.

To achieve the foregoing objects, the present invention is a multi-stage internal gear/turbine fuel pump for a vehicle including a housing having an inlet and an outlet and a motor disposed in the housing. The multi-stage internal gear/turbine fuel pump also includes a stationary shaft extending axially and disposed in the housing. The multi-stage internal gear/turbine fuel pump further includes a plurality of pumping modules disposed axially along the shaft. One of the pumping modules is a turbine pumping module and another of the pumping modules is a gerotor pumping module for rotation by the motor to pump fuel from the inlet to the outlet.

One advantage of the present invention is that a multi-stage internal gear/turbine fuel pump is provided for a vehicle. Another advantage of the present invention is that the multi-stage internal gear/turbine fuel pump is low cost, simple construction and eliminates the need for expensive dynamic shaft seals. Yet another advantage of the present invention is that the multi-stage internal gear/turbine fuel pump eliminates the need for mechanical coupling with a driving device. Still another advantage of the present invention is that the multi-stage internal gear/turbine fuel pump can be placed in the fuel line near the fuel tank or located in the fuel tank. A further advantage of the present invention is that the multi-stage internal gear/turbine fuel pump incorporates a high speed DC electrical motor, allowing for a quick priming of the pump and fast pressure/flow generating and eliminating the need for lift or prime pumps. Yet a further advantage of the present invention is that the multi-stage internal gear/turbine fuel pump is compact, modular and easy to assemble. Still a further advantage of the present invention is that the multi-stage internal gear/turbine fuel pump incorporates a plurality of modular gear pumping modules, allowing output pressure to be increased to a required value of direct injection fuel systems. Another advantage of the present invention is that the multi-stage internal gear/turbine fuel pump incorporates integral pressure regulation or pressure by feedback-speed control which simplifies the system to a single line supply typically called return-less or demand supply.

Other objects, features, and advantages of the present invention will be readily appreciated, as the same becomes better understood, after reading the subsequent description taken in conjunction with the accompanying drawings.

BRIEF DESCRIPTION OF THE DRAWINGS

FIG. 1 is a diagrammatic view of the multi-stage internal gear/turbine fuel pump, according to the present invention, illustrated in operational relationship in-line with a fuel tank in a direct injection fuel system.

FIG. 2 is a diagrammatic view of the multi-stage internal gear/turbine fuel pump, according to the present invention, illustrated in operational relationship disposed within a fuel tank in a direct injection fuel system.

FIG. 3 is a diagrammatic view of the multi-stage internal gear/turbine fuel pump, according to the present invention, illustrated in operational relationship in-line with a fuel tank in a direct injection fuel system.

FIG. 6 is an elevational view of a gerotor pumping module of the multi-stage internal gear/turbine fuel pump of FIGS. 1 through 3.

DESCRIPTION OF THE PREFERRED EMBODIMENT

Figure 4:
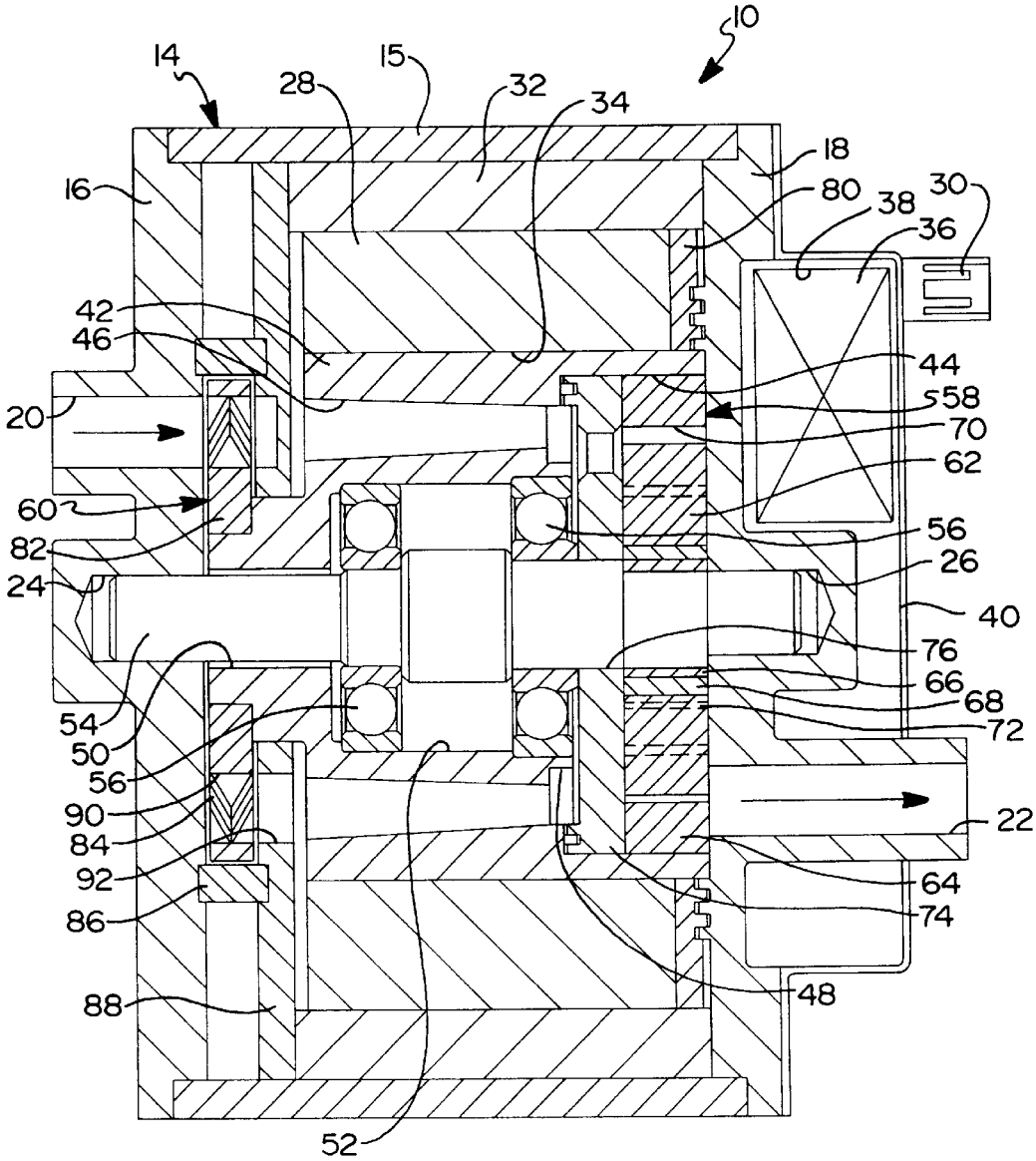
FIG. 4 is a fragmentary elevational view of the multi-stage internal gear/turbine fuel pump of FIGS. 1 through 3.

Referring to the drawings and in particular FIGS. 1 through 4, one embodiment of a multi-stage internal gear/turbine fuel pump 10, according to the present invention, is shown for fuel tank 12 of a vehicle (not shown). It should be appreciated that frequent use of the word "pressure" in the subsequent description of the invention may not imply delivery thereof.

As illustrated in FIG. 1, the multi-stage gear/turbine fuel pump 10 is used in a direct injection fuel system, generally indicated at 13, with closed loop electronic speed/pressure control. In the fuel system 13, the multi-stage internal gear/turbine pump 10 is a medium-pressure pump that can be located in the vehicle such as "in-line" close to the fuel tank 12 and connected to a fuel strainer 13*a* therein and a fuel filter 13*b* mounted outside the fuel tank 12. The fuel system 13 includes a fuel rail 13*c* connected by a high-pressure supply line to the fuel filter 13*b* and a plurality of fuel injectors 13*d* connected to the fuel rail 13*c*. As illustrated, the multi-stage internal gear fuel pump 10 may have closed-loop electronic pressure control via a pressure transducer 13*e* mounted to the fuel rail 13*c* or integral with the fuel pump 10 and controlled by an electronic controller (not shown) for pump speed-pressure feedback control. The multi-stage internal gear/turbine fuel pump 10 may be used in a supply and delivery system (not shown) for direct injection or for methanol/water delivery to a fuel cell reformer (not shown). The multi-stage internal gear/turbine fuel pump 10 may also be used for pumping volatile or non-volatile fluids (fuel or methanol) at a medium (3 Mpa.) or higher discharge pressure injected into cylinders (not shown) of a spark-ignition internal combustion engine (not shown) or fuel cell reformer. It should be appreciated that the fuel rail 13*c*, fuel injectors 13*d*, and pressure transducer 13*e* are located underhood or in an engine compartment (not shown) of the vehicle as represented by the dotted line and the other components of the fuel system 13 are located underbody of the vehicle. It should also be appreciated that the fuel system 13 provides power conservation, variable pressure, improved pressure and filter diagnostic, pump noise easier to control outside of the fuel tank 12, minimize heating of the fuel tank 12, and remote or integral pressure sensing.

As illustrated in FIG. 2, the multi-stage gear fuel pump 10 used in a direct injection fuel system, generally indicated at 13, with closed loop electronic speed/pressure control. In the fuel system 13, the multi-stage internal gear pump 10 is disposed in the fuel tank 12 and connected to a fuel strainer 13*a* therein and a fuel filter 13*b* mounted outside the fuel tank 12. The fuel system 13 includes a fuel rail 13*c* connected to the fuel filter 13*b* and a plurality of fuel injectors 13*d* connected to the fuel rail 13*c*. As illustrated, the multi-stage internal gear/turbine fuel pump 10 may have closed-loop electronic pressure control via a pressure transducer 13*e* mounted to the fuel rail 13*c* or integral with the fuel pump 10 and controlled by an electronic controller (not shown) for pump speed-pressure feedback control. It should be appreciated that the fuel rail 13*c*, fuel injectors 13*d*, and pressure transducer 13*e* are located underhood or in an engine compartment (not shown) of the vehicle as represented by the dotted line and the other components of the fuel system 13 are located underbody of the vehicle.

As illustrated in FIG. 3, the multi-stage internal gear/turbine fuel pump 10 is a medium-pressure pump that can be located in the vehicle such as "in-line" close to the fuel tank 12 and connected to a fuel strainer 13*a* therein and a fuel filter 13*b* mounted outside the fuel tank 12. The fuel system 13 includes a fuel rail 13*c* connected to the fuel filter 13*b* and a plurality of fuel injectors 13*d* connected to the fuel rail 13*c*. The multi-stage internal gear/turbine fuel pump 10 has an integral mechanical pressure regulator. The multi-stage internal gear/turbine fuel pump 12 may be used in a supply and delivery system (not shown) for direct injection or for methanol/water delivery to a fuel cell reformer (not shown). The multi-stage internal gear fuel pump 12 may also be used for pumping volatile or non-volatile fluids (fuel or methanol) at a medium (3 Mpa.) or higher discharge pressure injected into cylinders (not shown) of a spark-ignition internal combustion engine (not shown) or fuel cell reformer.

Referring to FIG. 4, the multi-stage internal gear/turbine fuel pump 10 includes a housing, generally indicated at 14. The housing 14 includes a common outer housing 15 extending axially, an inlet cover 16 extending radially and disposed at one axial end, and an outlet cover 18 extending radially and disposed at the other axial end. The outer housing 15 has a generally circular cross-sectional shape. The housing 14 also includes a fluid inlet 20 extending axially through the inlet cover 16 and a fluid outlet 22 extending axially through the outlet cover 18 for "in-line" pump construction. The inlet cover 16 and outlet cover 18 are generally circular in cross-sectional shape. The housing 14 further includes a shaft recess 24 in the inlet cover 16 and a shaft recess 26 in the outlet cover 18 for a function to be described. The housing 14 is made of a rigid material such as metal. It should be appreciated that the outer housing 15 extends from the inlet cover 16 to the outlet cover 18 to secure the housing 14 together, assuring the necessary compression that no leakage exists between pump stages and covers.

The multi-stage internal gear/turbine fuel pump 10 also includes a motor 28 disposed in the housing 14. The motor 28 is an off-shelf brushless direct current (DC) type for connection to a source of power such as an electronic controller (not shown) via a connector 30 connected to the housing 14. The motor 28 includes a stator 32 attached to the housing 14 and having a cylindrical cavity 34. The multi-stage internal gear/turbine fuel pump 10 includes an electronic speed control device 36 located in a compartment 38 of a speed control enclosure 40 attached to the outlet cover 18 of the housing 14 for connection to the electronic controller via the connector 30. It should be appreciated that the off-shelf electrical motor 28 provides a driving mechanism contained in the housing 14, eliminating any leak source and improving volumetric efficiency of the fuel pump 10. It should also be appreciated that the motor 28 is conventional and known in the art modified to contain and drive pumping elements to be described. It should further be appreciated that the speed control enclosure 40 can be placed on the inlet cover 16 or in any other area of the pump as deemed appropriate by design requirements.

The multi-stage internal gear/turbine fuel pump 10 also includes a rotatable rotor 42 disposed within the cavity 34 of the motor 28. The rotor 42 extends axially and has a rotor cavity 44 at one end thereof. The rotor 42 also has at least one, preferably a plurality of angled or tapered rotor passageways 46 extending axially through one end and communicating with the rotor cavity 44. The rotor 42 has an inlet cavity 48 at one end of the rotor passageways 46 adjacent the rotor cavity 44 for a function to be described. The rotor 42 further has a shaft passageway 50 centrally located and extending axially therethrough to receive a shaft 54 to be described. The rotor 42 has a bearing recess 52 disposed along the shaft passageway 50 for a function to be described. It should be appreciated that the rotor 42 has a hollow construction to accommodate the insertion and mounting of a gerotor outer gear to be described that is the driving element of a gerotor module to be described.

The multi-stage internal gear/turbine fuel pump 10 also includes a stationary shaft 54 disposed within and extending axially through the shaft passageway 50 of the rotor 42 and extending axially into the shaft recesses 24 and 26 of the inlet cover 16 and outlet cover 18, respectively. The multi-stage internal gear fuel pump 10 includes bearings 56 disposed in the bearing recess 52 about the shaft 54 for rotatably supporting or journaling the rotor 42. It should be appreciated that the bearings 56 are conventional and known in the art. It should also be appreciated that the shaft 54 extends axially inside the housing 14. It should further be appreciated that the shaft 54 is static.

The multi-stage internal gear/turbine fuel pump 10 also includes at least one, preferably a plurality of pumping modules, preferably a gerotor pumping module generally indicated at 58 and a turbine pumping module generally indicated at 60, disposed within the housing 14 and axially along the shaft 54 to pump fluid such as fuel. In the embodiment illustrated, the multi-stage internal gear/turbine fuel pump 10 includes two pumping modules 58 and 60. The gerotor pumping module 58 includes an internal or inner gear 62 and an outer or external gear 64 disposed in the rotor cavity 44 and mounted to the rotor 42 for rotation therewith. The internal gear 62 and external gear 64 are generally planar and circular in shape. The internal gear 62 has a plurality of external teeth disposed circumferentially thereabout and the external gear 64 has a plurality of internal teeth disposed circumferentially thereabout and meshing with the teeth of the internal gear 62 as illustrated in FIG. 6. The internal gear 62 is mounted by a ceramic shaft sleeve 66 and a ceramic inner gear bushing 68 on the shaft 54. The shaft sleeve 66 radially supports and journalizes the internal gear 62 and inner gear bushing 68. The shaft sleeve 66 is pressed onto the shaft 54 on an area the internal gear 62 is located to create a support and a wear resistant surface for the internal gear 62 and its inner gear bushing 68. The surface of the shaft sleeve 66 and the inner gear bushing 68 are pressure lubricated by the high pressure fluid penetrating in between them from the high pressure side of the gerotor pump module 58.

The internal gear 62 and external gear 64 have at least one, preferably a plurality of apertures 70 extending axially therethrough to allow fluid flow through the internal gear 62 and external gear 64. The internal gear 62 has at least one, or more bleed axial openings 72 that provide high pressure fluid for creating an hydraulic supporting fluid film under the gerotor pumping module 58, (balanced gerotor pressure), preventing wear of the gerotor pumping module 58 and an inlet plate 74 to be described. It should be appreciated that fluid flows axially between the teeth of the gears 62 and 64. It should also be appreciated that the output fluid discharge pressure depends on the number of stages or modules 58. It should also be appreciated that the output fluid flow/pressure is related to the size of the internal gear 62 and the external gear 64 and the number of stages built into the fuel pump 10. It should further be appreciated that the multi-stages or pumping modules makes possible a higher discharge pressure than an independent single pumping head. It should still further be appreciated that pumps produce flow and not pressure and that pressure, produced by restriction to flow, is controlled externally to each module and to the fuel pump 10 in its entirety such that requirements for proper pump function, including required flow, are achieved. It should be appreciated that multiples of the gerotor pumping module 58 could be stacked and commonly driven to produce a pump capable of much higher pressures; limited only by the cost, size and power requirements. Additionally, it should be appreciated that the number of gerotor pumping modules 58 is based on the desired output pressure and is a compromise between volumetric efficiency, which improves with more modules and mechanical efficiency, which decreases with more modules.

Each gerotor pumping module 58 further includes a pump stage inlet plate 74 disposed over the shaft 54 and in the rotor cavity 44 axially adjacent the internal gear 62 and external gear 64. The inlet plate 74 has a first or shaft passageway 76 extending axially therethrough to receive the shaft 54. The inlet plate 74 also has a pump module inlet port 78 spaced radially from the first passageway 76 and extending axially therethrough to communicate with the rotor passageway 46 of the rotor 42. Each inlet plate 74 is pressed on a specific diameter of the static shaft 54 and is maintaining an optimal face clearance with the internal gear 62 and external gear 64. It should be appreciated that the gerotor pumping module 58 is placed at the optimum clearance from the outlet cover 18. It should also be appreciated that maintaining the optimum clearance between the inlet plate 74, gerotor pumping module 58, and outlet cover 18 prevents excessive internal leakage and optimizes the pump volumetric efficiency.

The multi-stage internal gear/turbine fuel pump 10 also includes a labyrinth type sealing system 80 disposed axially between the motor 28 and outlet cover 18 and radially between the rotor 42 and stator 32. The sealing system 80 prevents leakage from the high-pressure side of the gerotor pumping module 58 back into the inlet cavity 48.

Each turbine pumping module 60 includes a turbine driver 82 solidly connected to the rotor 42. Each turbine pumping module 60 also includes a turbine impeller 84 disposed about the turbine driver 82. The turbine impeller 84 is mounted by suitable means to the turbine driver 82 for rotation therewith. Each turbine pumping module 60 includes a turbine ring 86 disposed about the turbine impeller 84. The turbine ring 86 is solidly mounted between the inlet cover 16 and a turbine outlet plate 88 that is pressed into a cylindrical cavity of the housing 14 to create a separation between a turbine compartment and a motor/gerotor compartment. The turbine driver 82, turbine impeller 84, and turbine ring 86 generally planar and circular in shape. The turbine impeller 84 has a plurality of special shaped blades disposed about the circumference. The turbine impeller 84 a plurality of apertures 90 extending axially therethrough to allow fluid flow through to a special shaped outlet port 92 in the turbine outlet plate 88. It should be appreciated that the turbine driver 82 and turbine impeller 84 rotate with the rotor 42.

In operation of the multistage internal gear/turbine fuel pump 10, the motor 28 rotates the rotor 42, which in turn rotates the turbine driver 82 and the turbine impeller 84 and also rotates the external gear 64 and internal gear 62. Fluid enters the inlet 20 as indicated by the arrow and flows through the apertures 90 of the turbine impeller 84 that increase the fluid pressure to a level that vapor creation and cavitations are prevented, and feeds through the inlet plate 74 and passageway 75 the first stage (set) of the gerotor pumping module 58. The fluid flows through the gerotor apertures 70 that create high-pressure flow to the outlet 22 in the outlet cover 18. It should be appreciated that, in the drawings, multistage internal gear/turbine fuel pump 10 relates to a multistage fuel pump for use in the supply and delivery system for a Low Pressure Direct Injection Gasoline Engine. It should also be appreciated that, however, this exemplary pump could be used for pumping any volatile or nonvolatile fluids at a medium discharge pressure of up to 3 MPa.

Figure 5:
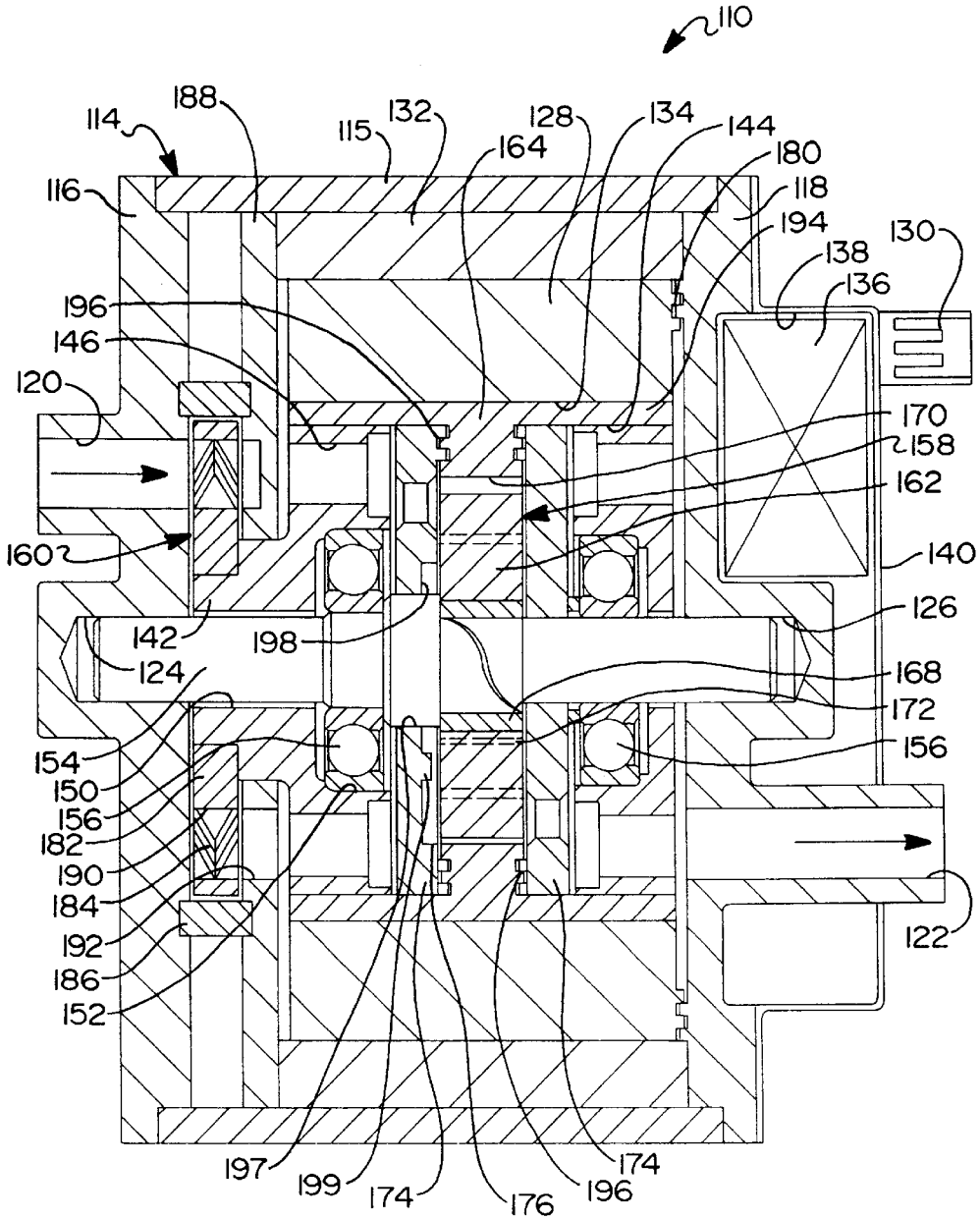
FIG. 5 is a fragmentary elevational view of another embodiment, according to the present invention, of the multi-stage internal gear/turbine fuel pump of FIGS. 1 through 3.

Referring to FIG. 5, another embodiment, according to the present invention, of the multistage internal gear/turbine fuel pump 10 is shown. Like parts have like numbers increased by one hundred (100). In this embodiment, the multistage internal gear/turbine fuel pump 110 has the rotor 142 with straight passageways 146 extending axially therethrough. The multistage internal gear/turbine fuel pump 10 also has the gerotor pumping module 158 disposed axially between a pair of inlet plates 174. The gerotor pumping module 158 has an external gear 164 with a flange 194 extending axially over the rotor 142 and inlet plates 174. The multistage internal gear/turbine fuel pump 10 further has a first labyrinth type sealing system 180 disposed axially between the motor 128 and outlet cover 118 and radially between the rotor 142 and stator 132, and a second labyrinth type sealing system 196 disposed axially between the external gear 164 and each inlet plate 174. The sealing system 80 prevents leakage from the high-pressure side of the gerotor pumping module 58 back into the inlet cavity 48. The multistage internal gear/turbine fuel pump 110 may include at least one shadow port 197 on the inlet plate 174 to balance pressure on faces of the internal gear 162 and the external gear 164. The inlet plate 174 may include a blind counterbore 198 with a feed in groove 199 to maximize port surface on a low pressure side of the external gear 164 in order to create a fluid film under the internal gear 162 and external gear 164. The operation of the multistage internal gear/turbine fuel pump 110 is similar to the multistage internal gear/turbine fuel pump 10.

The multistage internal gear/turbine fuel pump 10 includes two pumping modules 58 and 60, driven by a brushless speed controlled DC motor 28 integrated with the pumping modules 58 and 60, and the outer-driven gerotor pumping module 58, which eliminates the high friction between the outer gear 64 and the housing 14, typical in the more traditional inner gear driven pump. Additionally, the need for a shaft seal is eliminated. This is a compact design, using a modular internal gear gerotor pumping module 58 and a turbine pumping module 58, separated by inlet/outlet low clearance plates 74, 88 to deliver a steady flow and substantially contain the internal leakage of each module. The output fluid flow/pressure of the pump 10 is related to the size and efficiency of the gerotor pumping section 58.

The multistage internal gear/turbine fuel pump 10 makes possible higher discharge pressure than a single-stage gerotor. The motor 28 is speed controlled to effect a variable displacement thus allowing closed-loop pressure control of a system when combined with pressure feedback from a sensor (not shown). The turbine pumping module 60 improves the gerotor performance by preventing cavitations at high speeds and by decreasing the internal friction and by reducing the pressure differential. To improve efficiency, the number of teeth is minimized to reduce total tip leakage. Further face clearance is precisely maintained and inlet/ outlet ports are optimized to allow the maximum sealing area, also provided is a labyrinth type seal 80 between rotating and stationary pump elements to provide a better internal sealing and reduce the internal face leakage of the pump 10. Other features of the pump 10 include a pressure-balanced gerotor pumping module 48 and pressure lubricated bearings 56 and bushings to reduce friction and improve durability.

Accordingly, the multi-stage internal gear/turbine fuel pump 10 is sized to fit in-line or in a fuel tank of the vehicle, is modular and small size, compact construction. The multi-stage internal gear/turbine fuel pump 10 has a high working speed at start-up, works between −40 C. and 150 C., and is pulseless due to pumping nature of gear pumps. The multi-stage internal gear/turbine fuel pump 10 meets fuel emissions by totally containing the fuel in a sealed circuit, eliminating need for controlling the fuel emissions due to leak and pressure control by the motor speed control system. The multi-stage internal gear/turbine fuel pump 10 is maintenance free (sealed) and has high durability. The multi-stage internal gear/turbine fuel pump 10 has a simple construction for automated assembly, incorporates standard materials, simplifies the driving system, eliminating expensive dynamic seals, and creates a high pressure fluid state by connecting multiple pumping stages.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A multi-stage internal gear/turbine fuel pump comprising:

a housing having an inlet and an outlet;

a motor disposed in said housing;

a stationary shaft extending axially and disposed in said housing; and a plurality of pumping modules disposed axially along said shaft, one of said pumping modules being a turbine pumping module and another of said pumping modules being a gerotor pumping module for rotation by said motor to pump fuel from said inlet to said outlet.

2. A multi-stage internal gear/turbine fuel pump as set forth in claim 1 wherein said motor includes a stator connected to said housing and a rotor rotatably supported about said shaft.

3. A multi-stage internal gear/turbine fuel pump as set forth in claim 2 wherein said gerotor pumping module comprises an internal gear and an external gear cooperating with each other.

4. A multi-stage internal gear/turbine fuel pump as set forth in claim 3 wherein said gerotor pumping module includes an inlet plate disposed adjacent said rotor.

5. A multi-stage internal gear/turbine fuel pump as set forth in claim 2 wherein said turbine pumping module comprises a turbine driver connected to said rotor and a turbine impeller disposed about said turbine driver.

6. A multi-stage internal gear/turbine fuel pump as set forth in claim 5 wherein said turbine pumping module includes a turbine ring disposed about said turbine impeller and operatively connected to said housing.

7. A multi-stage internal gear/turbine fuel pump as set forth in claim 2 including a plurality of bearings for supporting said rotor about said shaft.

8. A multi-stage internal gear/turbine fuel pump as set forth in claim 1 including an outlet cover disposed axially adjacent a last one of said pumping modules and forming said outlet.

9. A multi-stage internal gear/turbine fuel pump as set forth in claim 1 including an inlet cover disposed axially adjacent a first one off said pumping modules and forming said inlet.

10. A multistage internal gear/turbine fuel pump as set forth in claim 1 wherein said each of said pumping modules provide a sealing surface disposed therebetween.

11. A multistage internal gear/turbine fuel pump as set forth in claim 1 wherein said each of said pumping modules includes either one of an inlet plate and an outlet plate.

12. A multi-stage internal gear/turbine fuel pump comprising:

a housing having an inlet and an outlet;

a motor disposed in said housing;

a stationary shaft extending axially and disposed in said housing;

a plurality of pumping modules disposed axially along said shaft, one of said pumping modules being a turbine pumping module and another of said pumping modules being a gerotor pumping module for rotation by said motor to pump fuel from said inlet to said outlet;

said motor including a stator connected to said housing and a rotor rotatably supported about said shaft;

said gerotor pumping module comprising an internal gear and an external gear cooperating with each other; and wherein said rotor has a cavity to receive said internal gear and said external gear.

13. A multi-stage internal gear/turbine fuel pump comprising:

a housing having an inlet and an outlet;

a motor disposed in said housing;

a stationary shaft extending axially and disposed in said housing;

a plurality of pumping modules disposed axially along said shaft, one of said pumping modules being a turbine pumping module and another of said pumping modules being a gerotor pumping module for rotation by said motor to pump fuel from said inlet to said outlet;

said motor including a stator connected to said housing and a rotor rotatably supported about said shaft;

said gerotor pumping module comprising an internal gear and an external gear cooperating with each other; and wherein said internal gear has a plurality of apertures extending axially therethrough.

14. A multi-stage internal gear/turbine fuel pump comprising:

a housing having an inlet and an outlet;

a motor disposed in said housing;

a stationary shaft extending axially and disposed in said housing;

a plurality of pumping modules disposed axially along said shaft, one of said pumping modules being a turbine pumping module and another of said pumping modules being a gerotor pumping module for rotation by said motor to pump fuel from said inlet to said outlet;

said motor including a stator connected to said housing and a rotor rotatably supported about said shaft;

said gerotor pumping module comprising an internal gear and an external gear cooperating with each other; and wherein said internal gear has a bleed passageway extending axially therethrough.

15. A multi-stage internal gear/turbine fuel pump comprising:

a housing having an inlet and an outlet;

a motor disposed in said housing;

a stationary shaft extending axially and disposed in said housing;

a plurality of pumping modules disposed axially along said shaft, one of said pumping modules being a turbine pumping module and another of said pumping modules being a gerotor pumping module for rotation by said motor to pump fuel from said inlet to said outlet;

said motor including a stator connected to said housing and a rotor rotatably supported about said shaft; and wherein said turbine pumping module includes a turbine driver connected to said rotor, a turbine impeller disposed about said turbine driver, and a turbine outlet plate disposed axially between said turbine driver and said turbine impeller and said rotor and connected to said housing.

16. A multi-stage internal gear/turbine fuel pump comprising:

a housing having an inlet and an outlet;

a motor disposed in said housing;

a stationary shaft extending axially and disposed in said housing;

a plurality of pumping modules disposed axially along said shaft, one of said pumping modules being a turbine pumping module and another of said pumping modules being a gerotor pumping module for rotation by said motor to pump fuel from said inlet to said outlet; and a pair of inlet plates spaced axially along said shaft, said gerotor pumping module being disposed between said inlet plates.

17. A multi-stage internal gear/turbine fuel pump comprising:

a housing having an inlet and an outlet;

a motor disposed in said housing;

a stationary shaft extending axially and disposed in said housing;

a plurality of pumping modules disposed axially along said shaft, one of said pumping modules being a turbine pumping module and another of said pumping modules being a gerotor pumping module for rotation by said motor to pump fuel from said inlet to said outlet; and an enclosure attached to an outlet end of said housing to enclose a motor speed control system.

18. A multi-stage internal gear/turbine fuel pump comprising:

a housing having an inlet and an outlet;

a motor disposed in said housing;

a stationary shaft extending axially and disposed in said housing;

a plurality of pumping modules disposed axially along said shaft, one of said pumping modules being a turbine pumping module and another of said pumping modules being a gerotor pumping module for rotation by said motor to pump fuel from said inlet to said outlet;

said motor including a stator connected to said housing and a rotor rotatably supported about said shaft; and wherein rotor includes a plurality of axial openings disposed in an axial angle for fluid flow from an outlet of said turbine pumping module to an inlet of said gerotor pumping module.

19. A multistage internal gear/turbine fuel pump comprising:

a housing having an inlet and an outlet;

a motor disposed in said housing;

a stationary shaft extending axially and disposed in said housing;

a plurality of pumping modules disposed axially along said shaft, one of said pumping modules being a turbine pumping module and another of said pumping modules being a gerotor pumping module for rotation by said motor to pump fuel from said inlet to said outlet;

each of said pumping modules including either one of an inlet plate and an outlet plate; and a labyrinth sealing system to seal said inlet plate and said outlet plate.

20. A multistage internal gear/turbine fuel pump comprising:

a housing having an inlet and an outlet;

a motor disposed in said housing;

a stationary shaft extending axially and disposed in said housing;

a plurality of pumping modules disposed axially along said shaft, one of said pumping modules being a turbine pumping module and another of said pumping modules being a gerotor pumping module for rotation by said motor to pump fuel from said inlet to said outlet;

said motor including a stator connected to said housing and a rotor rotatably supported about said shaft;

said gerotor pumping module comprising an internal gear and an external gear cooperating with each other; and wherein said rotor has a cavity, said external gear being disposed in said cavity and driven by said rotor.

21. A multistage internal gear/turbine fuel pump comprising:

a housing having an inlet and an outlet;

a motor disposed in said housing;

a stationary shaft extending axially and disposed in said housing;

a plurality of pumping modules disposed axially along said shaft, one of said pumping modules being a turbine pumping module and another of said pumping modules being a gerotor pumping module for rotation by said motor to pump fuel from said inlet to said outlet;

said motor including a stator connected to said housing and a rotor rotatably supported about said shaft;

said gerotor pumping module comprising an internal gear and an external gear cooperating with each other, and an inlet plate disposed adjacent said rotor; and at least one shadow port on said inlet plate to balance pressure on faces of said internal gear and said external gear.

22. A multistage internal gear/turbine fuel pump comprising:

a housing having an inlet and an outlet;

a motor disposed in said housing;

a stationary shaft extending axially and disposed in said housing;

a plurality of pumping modules disposed axially along said shaft, one of said pumping modules being a turbine pumping module and another of said pumping modules being a gerotor pumping module for rotation by said motor to pump fuel from said inlet to said outlet;

said motor including a stator connected to said housing and a rotor rotatably supported about said shaft;

said gerotor pumping module comprising an internal gear and an external gear cooperating with each other, and an inlet plate disposed adjacent said rotor; and wherein said inlet plate has a blind counter-bore with a feed in groove to maximize a port surface on a low pressure side of said external gear in order to create a fluid film under said internal and external gears.

23. A multistage internal gear/turbine fuel pump comprising:

a housing having an inlet and an outlet;

a motor disposed in said housing;

a stationary shaft extending axially and disposed in said housing;

a plurality of pumping modules disposed axially along said shaft, one of said pumping modules being a turbine pumping module and another of said pumping modules being a gerotor pumping module for rotation by said motor to pump fuel from said inlet to said outlet;

said motor including a stator connected to said housing and a rotor rotatably supported about said shaft;

said gerotor pumping module comprising an internal gear and an external gear cooperating with each other; and axial openings in said internal gear to pressure balance said internal and external gears and pressure lubricate bearings disposed about said shaft and rotatably supporting said rotor.

24. A multi-stage internal gear/turbine fuel pump comprising:

a housing having an inlet and an outlet;

a motor disposed in said housing;

a stationary shaft extending axially and disposed in said housing; and a plurality of pumping modules disposed axially along said shaft, one of said pumping modules having an internal gear and an external gear cooperating with each other for rotation by said motor and another of said pumping modules having a turbine driver and turbine impeller to pump fuel from said inlet to said outlet.

25. A multi-stage internal gear/turbine fuel pump as set forth in claim 24 wherein said motor includes a stator connected to said housing and a rotor rotatably supported about said shaft.

26. A multi-stage internal gear/turbine fuel pump as set forth in claim 24 including a turbine ring disposed about said turbine impeller and operatively connected to said housing.

27. A multi-stage internal gear/turbine fuel pump as set forth in claim 24 including an outlet cover disposed axially adjacent a last one of said pumping modules and forming said outlet.

28. A multi-stage internal gear/turbine fuel pump as set forth in claim 24 including an inlet cover disposed axially adjacent a first one of said pumping modules and forming said inlet.

29. A multi-stage internal gear/turbine fuel pump comprising:

a housing having an inlet and an outlet;

a motor disposed in said housing;

a stationary shaft extending axially and disposed in said housing;

a plurality of pumping modules disposed axially along said shaft, one of said pumping modules having an internal gear and an external gear cooperating with each other for rotation by said motor and another of said pumping modules having a turbine driver and turbine impeller to pump fuel from said inlet to said outlet; and wherein said motor includes a rotor having a cavity to receive said internal gear and said external gear.

30. A multi-stage internal gear/turbine fuel pump as set forth in claim 29 including at least one inlet plate disposed adjacent said internal gear and said external gear.

31. A multi-stage internal gear/turbine fuel pump comprising:

a housing having an inlet and an outlet;

a motor disposed in said housing;

a stationary shaft extending axially and disposed in said housing;

a plurality of pumping modules disposed axially along said shaft, one of said pumping modules having an internal gear and an external gear cooperating with each other for rotation by said motor and another of said pumping modules having a turbine driver and turbine impeller to pump fuel from said inlet to said outlet;

a turbine ring disposed about said turbine impeller and operatively connected to said housing; and a turbine outlet plate disposed axially between said turbine driver and said turbine impeller and said motor and connected to said housing.

32. A multi-stage internal gear/turbine fuel pump comprising:

a housing;

a motor disposed in said housing;

a stationary shaft extending axially and disposed in said housing; and a rotatable rotor rotatably disposed about said shaft for rotation by said motor;

a plurality of pumping modules disposed axially along said shaft and cooperating with said rotor;

one of said pumping modules being a turbine pumping module and another of said pumping modules being a gerotor pumping module for rotation by said rotor;

said turbine pumping module having a turbine driver and a turbine impeller cooperating with each other for rotation by said rotor;

said gerotor pumping module having an internal gear and an external gear cooperating with each other for rotation by said rotor;

an inlet cover connected to said housing and disposed axially adjacent a first one of said pumping modules and forming an inlet to allow fuel to enter;

an outlet cover connected to said housing and disposed axially adjacent a last one of said pumping modules and forming an outlet to allow fuel to exit.

* * * * *